United States Patent [19]

Wright et al.

[11] 4,272,746

[45] Jun. 9, 1981

[54] FOUR POLE DOUBLE THROW RELAY

[75] Inventors: William W. Wright, Wheaton; Frank S. Vojir, Downers Grove, both of Ill.

[73] Assignee: Guardian Electric Manufacturing Company, Chicago, Ill.

[21] Appl. No.: 65,097

[22] Filed: Aug. 9, 1979

[51] Int. Cl.[3] ..... H01H 67/02

[52] U.S. Cl. ..... 335/128; 335/133; 335/185

[58] Field of Search ..... 335/127, 128, 129, 133, 335/185, 203

[56] References Cited

U.S. PATENT DOCUMENTS

| | | | |
|---|---|---|---|
| 2,495,325 | 1/1950 | Hamilton | 335/128 |
| 3,014,103 | 12/1961 | Moran et al. | 335/129 X |
| 3,302,142 | 1/1967 | Piechotta | 335/128 |

FOREIGN PATENT DOCUMENTS

| | | | |
|---|---|---|---|
| 2614926 | 10/1977 | Fed. Rep. of Germany | 335/128 |

*Primary Examiner*—George Harris

*Attorney, Agent, or Firm*—Allegretti, Newitt, Witcoff & McAndrews

[57] ABSTRACT

A multipole, double throw relay includes a base with a coil and armature mounted at the center of the base. A terminal block with an L-shaped cantilever contact blade is mounted on one side of the coil. The contact blade extends up and over the coil, passes through a contact blade lifter affixed onto the armature and projects between a pair of contacts associated with a contact block assembly mounted on the opposite side of the coil. Operation of the coil causes the lifter to engage and move the flexible contact blade. The lifter has a lost motion action that prevents contact flutter and provides for a more efficient switching operation.

11 Claims, 6 Drawing Figures

74
72
40
80
82
82
84
86
64
36
42
68
30
.32
40
18
34
38
26
69
76
28
70
20
68
78
52
66
67
46
54
62
60
56
14
50
10
12
48
58
44

FOUR POLE DOUBLE THROW RELAY

BACKGROUND OF THE INVENTION

In a principal aspect the present invention relates to a multipole, double throw relay and more particularly to a relay having a compact and modular construction.

Electrical relays provide an important and valuable function in the control of many mechanical and electrical devices. The type and complexity of electrical relays has, in recent years, expanded enormously. A particular type of relay useful in many applications is known as a double throw relay. This type of relay normally includes a contact blade which is positioned in contact with one or the other of a pair of opposed contact members in response to current passing through an actuating coil. In this manner, as one circuit is broken a new circuit is made and vice versa.

It is often desirable to have a plurality of contacts make and break multiple circuits simultaneously in response to operation of a single control signal. This is normally done by employing an armature which will engage or operate a plurality of contact blades in response to current through a single coil. Typically two, three and four pole relays are available, although larger numbers of contact blades may be operated by the same coil.

A problem often encountered with such relays relates to the ease, quickness and sharpness of making and breaking a relay contact. Preferably such making and breaking of circuits should be as sharp and uniform as possible. That is, the switching action associated with each pole of a multipole relay should occur simultaneously. Another desirable characteristic for such relays is the provision of a wiping action by the contacts during the making of a circuit. A wiping action insures a positive making of a circuit and tends to reduce sparking between gaps defined by a pair of opposed contacts. Finally, of course, it is preferred that the contacts disengage in a fast, clean and effective manner again to avoid creation of sparks or arcing. The present invention is believed to accomplish these objectives and solve the recited problems.

SUMMARY OF THE INVENTION

Briefly, the present invention constitutes an improved multipole, double throw relay. The relay includes a base member with a coil mounted on the base member intermediate the sides of that base member. A terminal block is mounted on one side of the coil and a contact block assembly is mounted on the opposite side of the coil. A flexible contact blade extends from the terminal block over the end of the coil and terminates with contacts that project between contact blades defined in the contact block assembly. An armature lifter is positioned over the coil and moves in response to current passing through the coil. The armature lifter is of a special construction that cooperates with the flexible contact blade to permit slight motion of the lifter before the contact blades are engaged and moved to make or break a circuit.

It is thus an object of the invention to provide an improved multipole relay.

A further object of the present invention is to provide an improved multipole, double throw relay which includes an armature construction adapted to engage flexible contact blades associated with the relay for improved making and breaking of a circuit.

Still another object of the present invention is to provide a multipole, double throw relay of generally modular construction which may be converted into a two, three or four pole relay without dramatic structural changes.

Still another object of the present invention is to provide a multipole, double throw relay which is simple in construction, easy to service and repair.

Another object of the present invention is to provide a multipole relay which is inexpensive to manufacture and maintain.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
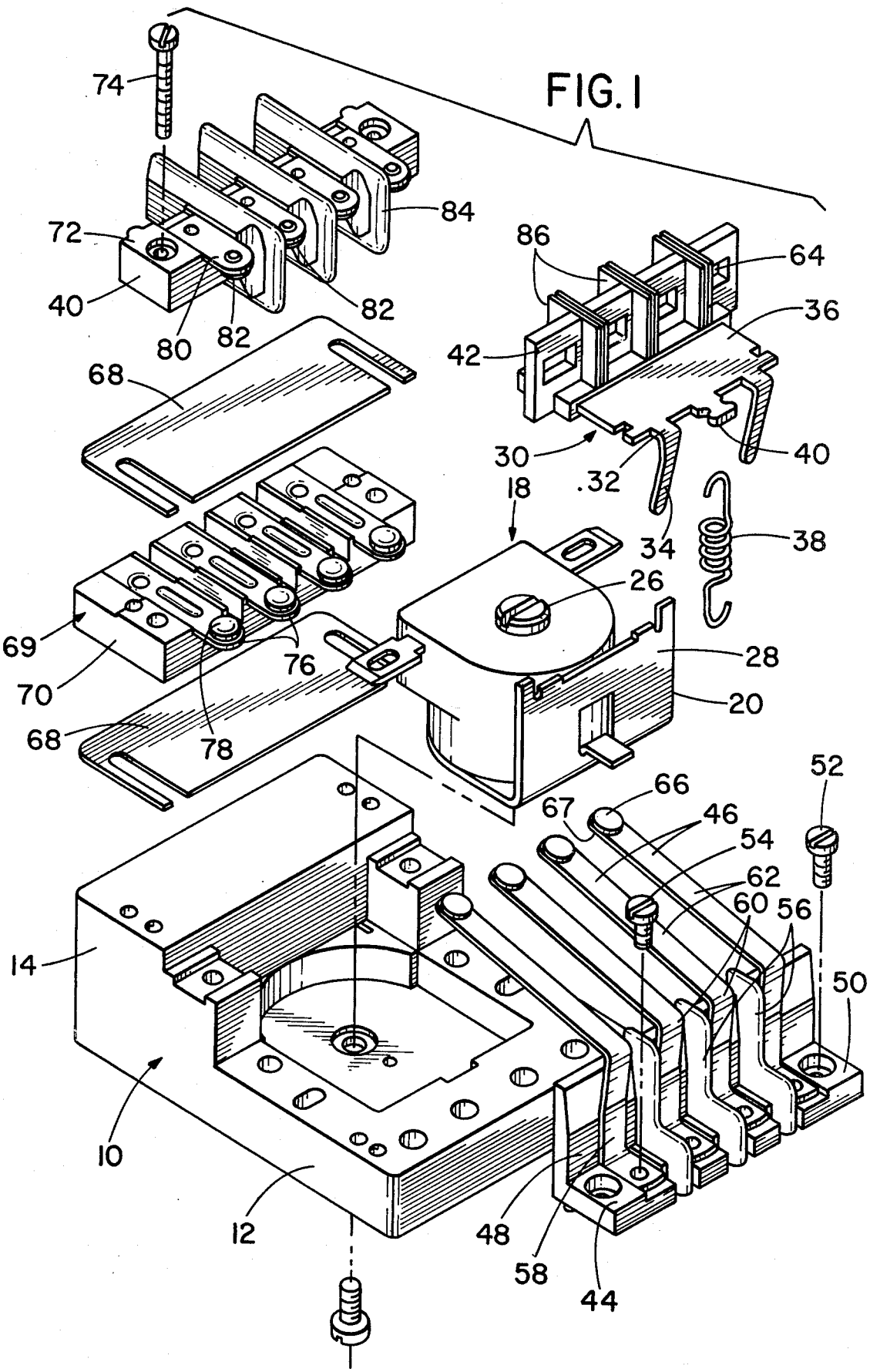
FIG. 1 is an exploded perspective view of the improved relay of the present invention wherein the invention is incorporated in a four pole relay.

Referring to the drawings, the present invention is illustrated as a four pole, double throw relay. It is possible, however, to incorporate the invention in any single pole or multipole relay device. Additionally, the relay need not necessarily be a double throw relay.

The relay includes a base or housing 10 which is fabricated from a molded insulating plastic material. The base 10 includes a generally planar section 12 and an elevated section 14. The underneath or bottom side of the base 10 is generally hollow so that contact leads passing through the base may be connected to a circuit board assembly (for example, circuit board assembly 16 as depicted in phantom in FIG. 2).

A coil assembly 18 is mounted on the planar section 12 of base 10 substantially at the middle of the base 10. The coil assembly 18 includes a field piece 20. The field piece 20 connects with a core 26 affixed to the field piece 20. A bobbin 24 with a wound coil 22 is mounted on core 26. The field piece 20 also includes an upstanding leg 28 parallel to the axis of the coil 22. Leg 28 supports an L-shaped armature assembly 30.

The armature assembly 30 includes an armature 32 having a first leg 34 generally parallel to the axis of coil 22 connected with a second leg 36 that is generally perpendicular to the axis of coil 22. Leg 36 is pivotally mounted on leg 28 of field piece 20. A spring 38 connects from a tang 40 which is an extension of leg 36 to the planar section 12 of base 10. The lower end of leg 34 limits the spring biased pivotal movement of armature 32 about the pivot point on leg 28 of field piece 20.

A lifter 42 is affixed onto the leg 36 of armature 32. The armature 32 and lifter 42 move in response to passage of current through coil 22 between the positions shown in FIGS. 2 and 4. Parallel walls 86 associated with lifter 42 insulate the contact blades 46 from one another. The lifter 42 cooperates with a contact blade assembly in a manner described below.

Positioned on one side of the coil 22 on the planar section 12 adjacent the leg 34 of the armature 32 is a terminal block 44 including flexible, cantilever contact blades 46. The terminal block 44 includes a molded upstanding blade support wall 48 extending upwardly from a base 50. The base 50 is held attached to the housing 12 by means of screws 52. The contact blade 46 is held attached to the base 50 by an attachment screw 54. A series of molded, insulating parallel walls 56 separate the contact blades 46.

The contact blade 46 includes a first vertical run 58 which is supported by wall 48. Run 58 is connected by a curved or turned section 60 to a straight, substantially horizontal run 62. The run 62 extends over the coil 22 through an opening 64 defined in lifter 42. The run 62 terminates with opposed contacts 66, 67 affixed at the end thereof.

Arranged on the opposite side of the coil 22 is a fixed contact block assembly 69 comprised of a mounting shim or shims 68 with a first, lower contact block 70 and a second, upper contact block 72, all arranged on the elevated section 14 and attached thereto by a pair of screws 74. The lower contact block 70 includes a fixed contact blade 76 with a contact 78 positioned in the path of movement of the contact 67 of blade 46. The upper contact block 72 likewise includes a fixed blade 80 with a contact 82 arranged in the path of the contact 66 of blade 46. The contacts 66, 67 are thus positioned intermediate the contacts 78 and 82. The gap between contacts 78 and 82 is sufficient to ensure that a circuit may be made with one of the contacts 66 while remaining broken with the other contact 67 and vice versa.

An insulating wall 84 defined in upper contact block 72 separates the contact blades 76, 80 of adjacent poles of the relay.

Figure 2:
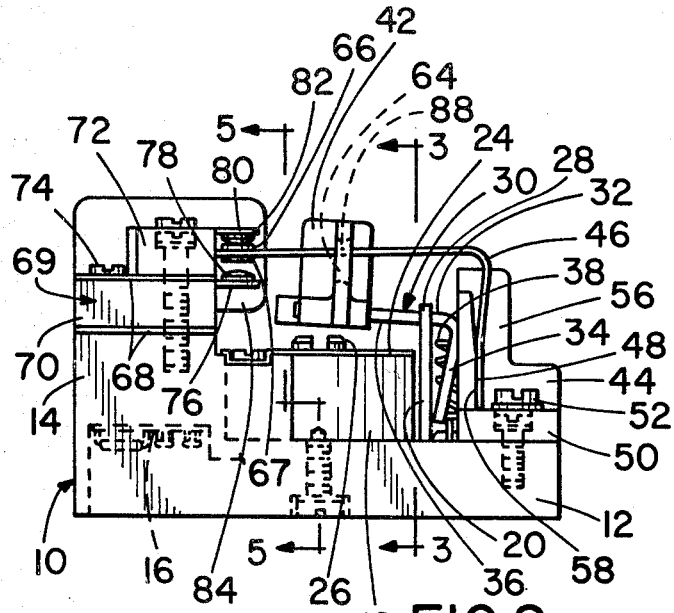
FIG. 2 is a side plan view of the relay of FIG. 1.
Figure 3:
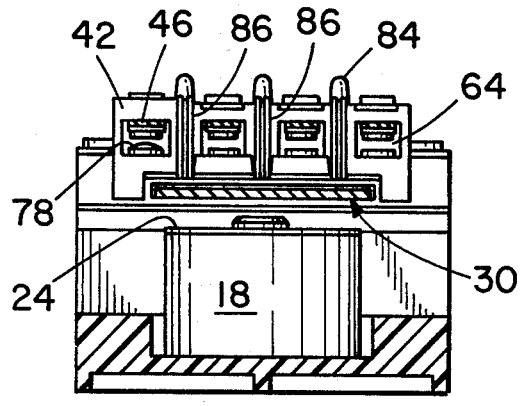
FIG. 3 is a cross sectional view through the relay of FIG. 2 taken substantially along the line 3—3.

When the relay is in the unenerigized position as illustrated in FIG. 2, the cantilever spring effect of the blade 46 causes the upper contact 66 to engage the fixed contact 82 in a wiping action as shown in FIG. 2. When the relay is in this described position, the opening 64 of lifter 42 is positioned to define a gap 88 between the top of the opening 64 and the run 62 of blade 46.

Figure 4:
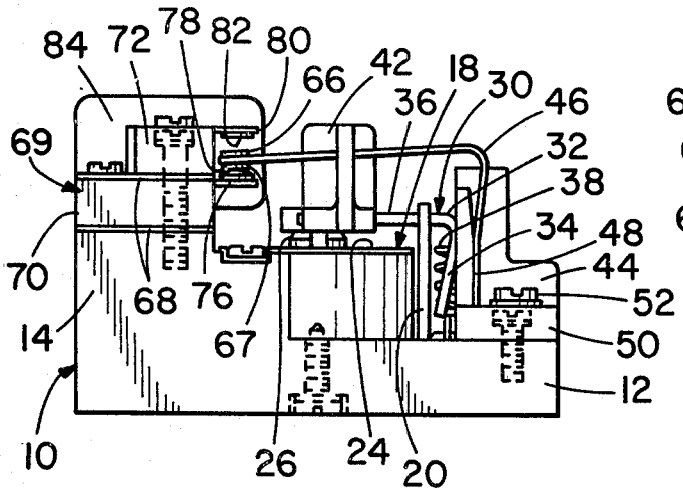
FIG. 4 is a side plan view of the relay of FIG. 1 wherein the armature of the relay has been actuated.
Figure 5:
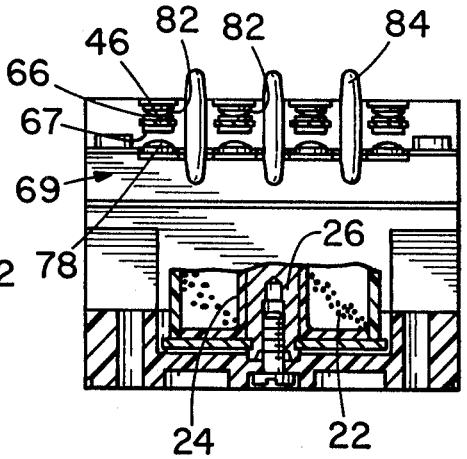
FIG. 5 is a cross sectional view through the relay shown in FIG. 4 taken substantially along the line 4—4.
Figure 6:
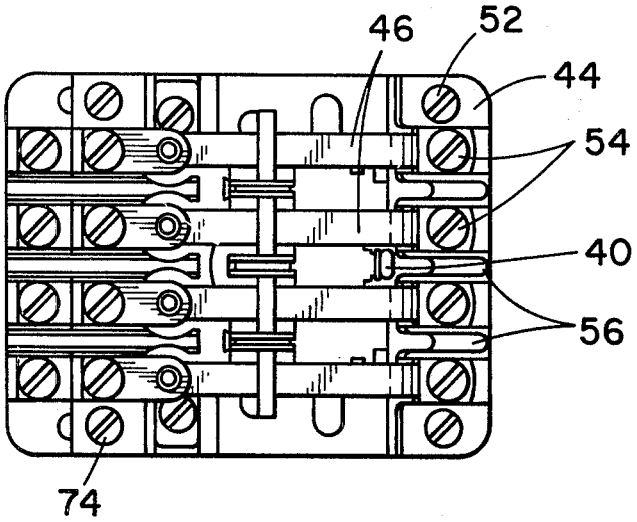
FIG. 6 is a top plan view of the relay shown in FIG. 2.

Upon actuation of the coil 22 the armature assembly 30 is moved in a generally counterclockwise direction as viewed in FIG. 2 to the position of FIG. 4. In this manner, the lifter 42 is caused to move downward and engage the blades 46 thereby driving contacts 66 from contacts 82 and causing contacts 67 and 78 to become engaged and make a circuit. Movement of the lifter 42 and transport of the contacts as described causes a wiping action in the making and breaking of a circuit. Note also that the gap 88 permits the lifter 42 to build momentum prior to engagement with the contact blades 46 thereby providing for a sharp and quick break of contacts 66 and 82. This improves the switching action greatly.

With the relay of the present invention it is possible to include any one or all of the blades 46 in the assembly of a four pole relay to provide from a one to a four pole relay. For example, the two outside contact blades 46 may be omitted to provide a two pole, double throw relay. The number and spacing of shims 68 may be varied in order to vary contact spacing. Likewise, it is possible to position shims between blocks 70 and 72 to adjust fixed contact spacing. Also, if any of the parts of the device fail, they can be easily replaced merely by removing one of the five screws which are used for assembly. The parts are modular and substantially interchangeable. Ease of access to the parts of the relay for purposes of repair or modification is facilitated.

Various departures from the relay construction as described are possible. Therefore, the invention is to be limited only by the following claims and their equivalents.

What is claimed is:

1. An improved double throw multipole relay comprising, in combination:

(a) a base member;

(b) a coil member on the base member intermediate the sides of the base member and including a vertical field piece core for the coil;

(c) a terminal block on one side of the coil including at least one flexible contact blade attached thereto and extending as a cantilever over the coil core to the opposite side of the core, said blade terminating with a contact;

(d) an armature lifter affixed to a spring biased armature on the field piece, said lifter including an opening for receipt of the flexible contact blade, said opening defining a predetermined gap between the blade and lifter whereby said lifter is moved through said gap width prior to engagement with the blade upon actuation of the relay; and (e) a fixed contact assembly on the opposite side of the coil from the terminal block, said fixed contact assembly including a contact mounted in the path of said flexible blade contact.

2. The improved relay of claim 1 wherein said fixed contact block assembly includes a modular insulating block member mounted on the base and a contact attached to the modular block member for cooperation with the flexible contact blade contact.

3. The improved relay of claim 1 wherein said fixed contact block assembly includes a first lower modular contact block and associated lower contact blade and contact mounted on the base, blade and an upper modular contact block mounted on the lower contact block, said upper block also including a contact blade and contact, said contact blocks being keyed to one another and to the base.

4. The improved relay of claim 1 including electrical connection means projecting through said base to said terminal block and fixed contact block assembly.

5. The improved relay of claim 1 in combination with a circuit board positioned within a hollow defined in the base of said base member.

6. The improved relay of claim 1 including a plurality of flexible contact blades arranged in side by side relation for cooperation with a plurality of separate pairs of contacts incorporated in the fixed contact block assembly, each of said contact blades having associated contacts being separated from each other by insulating walls incorporated in the fixed contact block assembly, armature lifter and terminal block.

7. The improved relay of claim 1 wherein said lifter is affixed onto the armature and includes an enclosed passage associated with each flexible contact blade and through which each such flexible contact blade extends, said opening extending parallel with the flexible blade defining said gap.

8. The improved relay of claim 1 wherein said flexible contact blade is generally L-shaped and includes a first run generally transverse to the axis of the coil with the contact member at one end of the first run, and also including a second run generally parallel to the axis of the coil and attached at its free end to the terminal block.

9. The improvement of claim 1 including shim means insertable between the base member and the fixed contact block assembly to thereby adjust the position of the contact on the fixed contact block assembly relative to the contact on the flexible contact blade.

10. The improvement of claim 1 including two contacts on the end of the flexible contact blade cooperative with two spaced, opposed contacts mounted on the fixed contact assembly.

11. The improvement of claim 3 wherein said fixed contact assembly includes shim means for adjusting the position of the fixed contacts.

* * * * *